United States Patent [19]

Costa

[11] 4,395,150

[45] Jul. 26, 1983

[54] TYPEWRITER DECIMAL TAB MECHANISM

[75] Inventor: Jorge Costa, Yverdon, Switzerland

[73] Assignee: Hermes Precisa International S.A., Yverdon, Switzerland

[21] Appl. No.: 166,972

[22] PCT Filed: Feb. 13, 1979

[86] PCT No.: PCT/CH79/00024

§ 371 Date: Oct. 14, 1979

§ 102(e) Date: Aug. 28, 1979

[87] PCT Pub. No.: WO79/00621

PCT Pub. Date: Sep. 6, 1979

[30] Foreign Application Priority Data

Feb. 14, 1978 [CH] Switzerland ..... 1607/78

[51] Int. Cl.[3] ..... B41J 21/14

[52] U.S. Cl. ..... 400/285; 400/285.1; 400/285.2; 400/286; 400/296.1; 400/298

[58] Field of Search ..... 400/285, 285.1, 285.2, 400/285.3, 285.4, 285.5, 285.6, 286, 286.1, 286.2, 286.3, 296.1, 297.1, 298, 295

[56] References Cited

U.S. PATENT DOCUMENTS

| | | | |
|---|---|---|---|
| 858,082 | 6/1907 | Lecoultre | 400/286.2 |
| 918,722 | 4/1909 | Allard | 400/286 |
| 1,382,971 | 6/1921 | Garrett | 400/285.1 |
| 3,279,577 | 10/1966 | Menicanti | 400/295 |
| 3,346,089 | 10/1967 | Cralle, Jr. et al. | 400/296.1 X |
| 3,554,350 | 1/1971 | Rolph et al. | 400/296.1 |
| 3,978,967 | 9/1976 | Gagnebin | 400/285 |

FOREIGN PATENT DOCUMENTS

| | | |
|---|---|---|
| 1423119 | 11/1965 | France . |
| 2243826 | 3/1979 | France . |

*Primary Examiner*—Ernest T. Wright, Jr.
*Attorney, Agent, or Firm*—Emory L. Groff, Jr.

[57] ABSTRACT

A decimal tab mechanism for a typewriter of the type having a printing element carried by a carriage comprises a tab bar 1 capable of being displaced longitudinally and comprising a series of tab blades 2 which may be separately selected. A stop 19 of bar 1 is capable of cooperating with a decimal tab stop 67 placed in active position from an assembly of decimal tab stops 67.

Said mechanism further comprises an apparatus 28, 35–41 for driving bar 1 longitudinally ahead in the direction of typing, a cam 28 for the placing in active position of the selected tab blades 2 before longitudinal displacement of tab bar 1, and connection means 50–62 between a drive shaft 29 and the assembly of decimal tab stops 67 comprising devices 51, 53, 54 for assuring that a selected decimal tab stop 67 is placed in active position only after longitudinal displacement of tab bar 1.

7 Claims, 18 Drawing Figures

FIG. 13
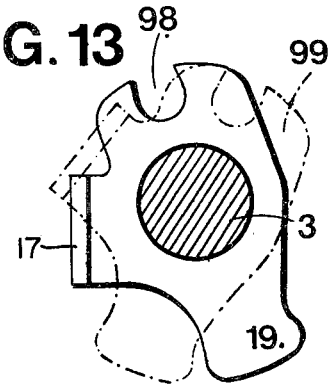
FIG. 12
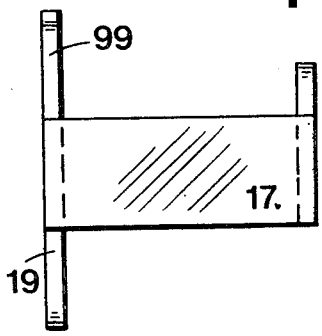
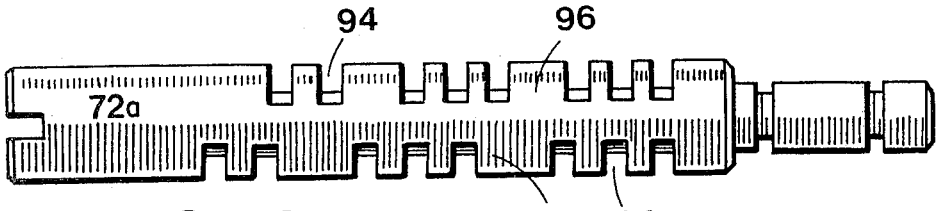
FIG. 14
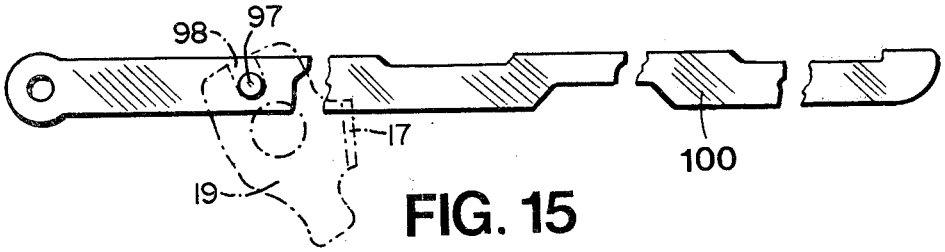
FIG. 15
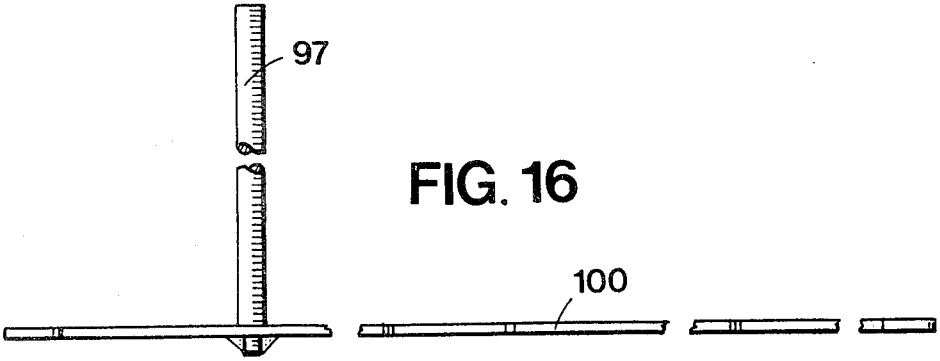
FIG. 16

TYPEWRITER DECIMAL TAB MECHANISM

The present invention concerns a decimal tab mechanism for a typewriter of the type having a printing element carried by a carriage moving parallel to a platen, said mechanism comprising a tab bar capable of moving longitudinally and having a series of tab blades which may be separately selected, means for activating the selected tab blades in order to place them in active position so as to cooperate with a carriage stop, an assembly of decimal tab stops, each controlled by a key on the keyboard so as to be held active and to cooperate with a stop on the tab bar, and a drive shaft connected by temporary coupling means to a continuously rotating machine function shaft.

The instant construction provides an improvement over earlier tab mechanisms such as depicted in U.S. Pat. No. 3,978,967 issued Sept. 7, 1976 to Gagnebin. In the known mechanism according to the Gagenbin patent, when a tabulation is performed, the carriage displaces from left to right with its stop contacting a tab blade in the active position. The tab bar is then drawn by the carriage and moves longitudinally until it meets the decimal tab stop corresponding to the activated key on the keyboard. The decimal tab stop effects a blocking of the carriage in the position reached and, by means of a spring, the bar resumes its rest position.

In said mechanism, it is necessary to place the tab blades in a staggered position above the position chosen for the ones column. The staggering depends on the spacing of the decimal tab stops and it is generally not possible to perform a tabulation when the carriage is less than ten spaces from the given ones column. This complicates use of the typewriter, since one must provide at least 10 spaces between the last strike before tabbing and the chosen ones column.

The purpose of the invention is to eliminate this problem, so as to make the use of decimal tabulation on a moving printing element typewriter identical to its use on movable platen typewriters.

The decimal tab mechanism of the invention is characterized in that it comprises an apparatus for displacing the tab bar longitudinally ahead in the direction of typing, said apparatus being activated by the drive shaft by means of a spring, a cam driving the means for activating the selected tab blade, said cam being integral with the drive shaft and acting on said activation means before the longitudinal displacement of the tab bar, and connection means between the drive shaft and the decimal tab stops, said connection means having devices for moving a selected decimal tab stop into active position only after longitudinal displacement of the tab bar.

The attached drawing represents schematically and by way of example one form of embodiment of the decimal tab mechanism subject of the invention.

FIGS. 10 through 16 are detail views of a modification.

Figure 1:
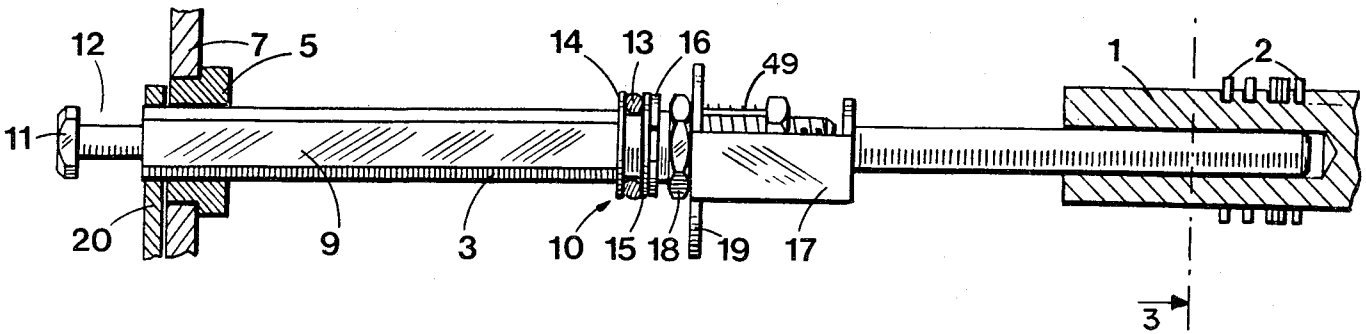
FIGS. 1 and 2 are front views with a partial section of the left and right ends of a tab bar.

The typewriter shown in the drawing comprises a chassis or body 112, a platen 46 and a printing element 44 carried on a carriage 45 moving parallel to the platen 46.

Figure 2:
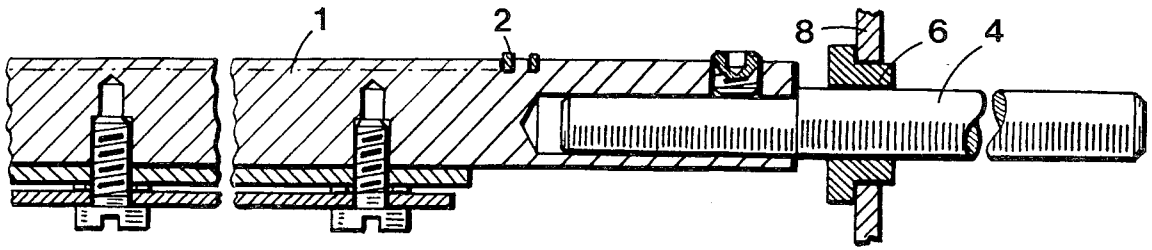
Figure 3:
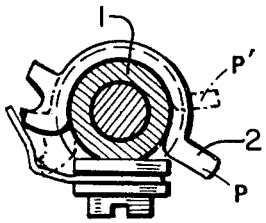
FIG. 3 is a partial section of part of the mechanism along line 3—3 of FIG. 1.

The tab bar represented in FIGS. 1 and 2 is constituted by a rod 1 carrying a series of tab blades 2 of which each may occupy two positions, position P′ in which it is set, and position P, in which it is cleared as shown in FIG. 3.

At each extremity of rod 1 is mounted an axle 3,4 guided in a block 5, 6 disposed in a lateral wall 7, 8 of the machine. Axle 3 comprises a longitudinal milled surface 9 extending from an axial stop 10 to lateral wall 7. An arm 12 having an end piece 11 is fashioned in the latter beyond lateral wall 7 from rod 1. Stop 10 is an elastic stop constituted by a washer of elastic material 13 disposed between two washers 14 and 15 of which one, 15, rests against circlip 16. Stop 10 limits the leftward sliding of the tab bar by coming to rest against block 5. Stop piece 17 is affixed in translation to axle 3 and is supported on one side against a nut 18 screwed onto threads in axle 3 and on the other against a compression spring 49. The position of stop piece 17 on axle 3 may be adjusted by means of nut 18. Said stop piece 17 comprises a plate 19 capable of cooperating with a decimal tab stop 67 when the tab bar slides from left to right. The tab bar may occupy two positions, active and inactive, movement from one position to the other being controlled through a lever 20 angularly connected to axle 3.

A tab blade 2 in selected position may cooperate with a carriage stop 47 only if the tab bar is in active position.

Figure 7:
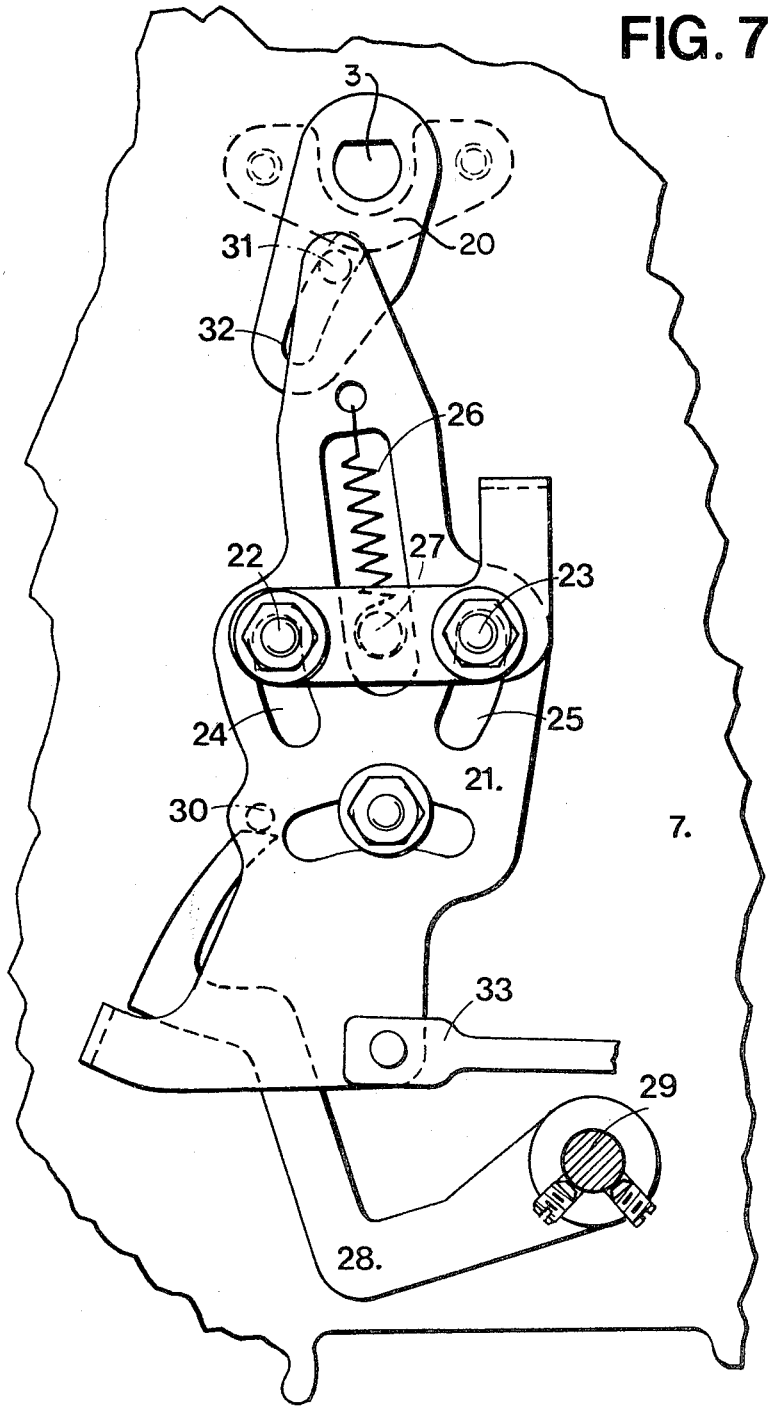
FIG. 7 is a partial view of the mechanism.
Figure 8:
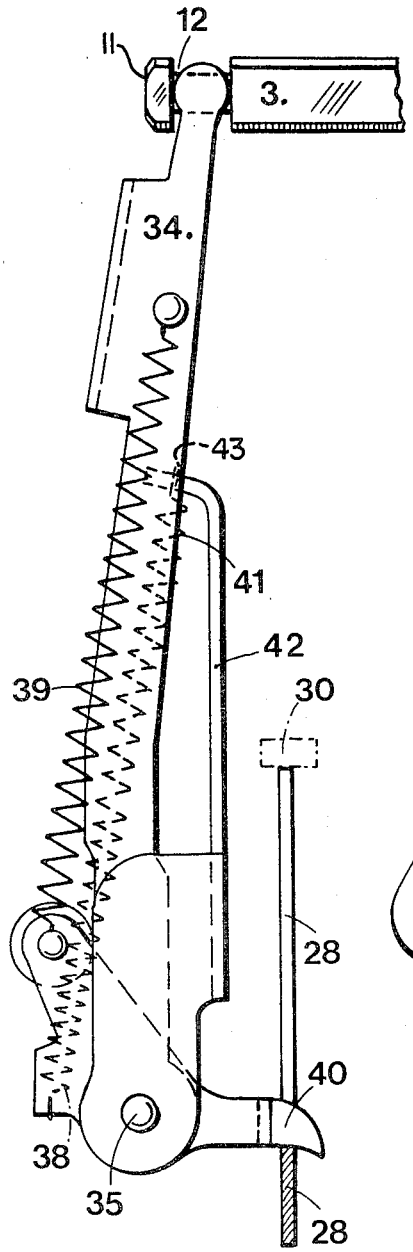
FIGS. 8 and 9 represent another part of the mechanism in cutaway elevation.
Figure 9:
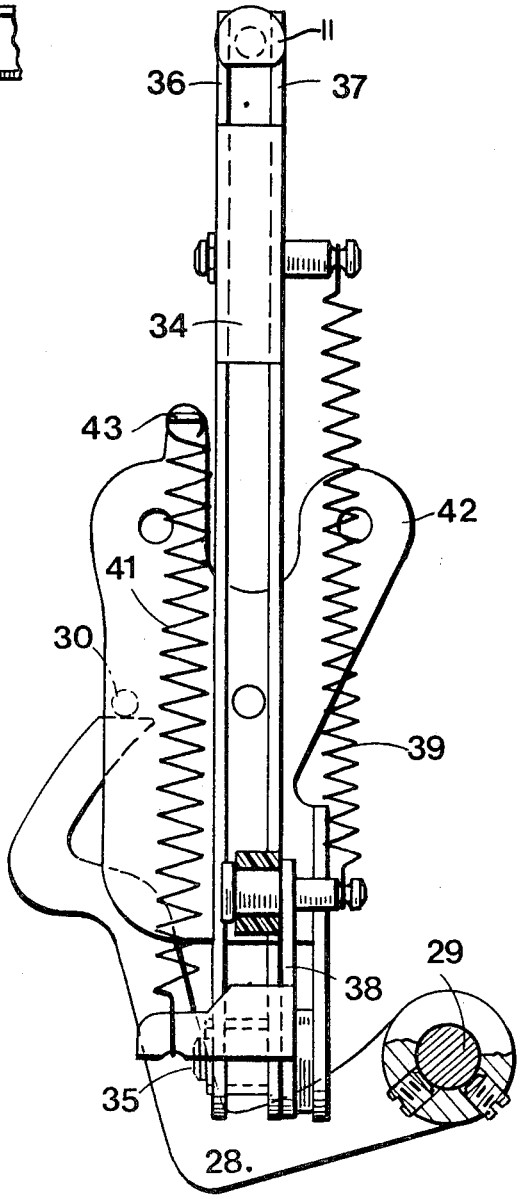

The tab bar is made to rotate and slide by a drive apparatus represented in FIGS. 7 through 9. Said apparatus comprises a rocker 21 capable of pivoting around axes 22 and 23, the latter being engaged in slots 24 and 25 of rocker 21. The movements of the rocker 21 occur against the force of a return spring 26 connected at one of its extremities to a fixed part 27 of the machine.

Figure 17:
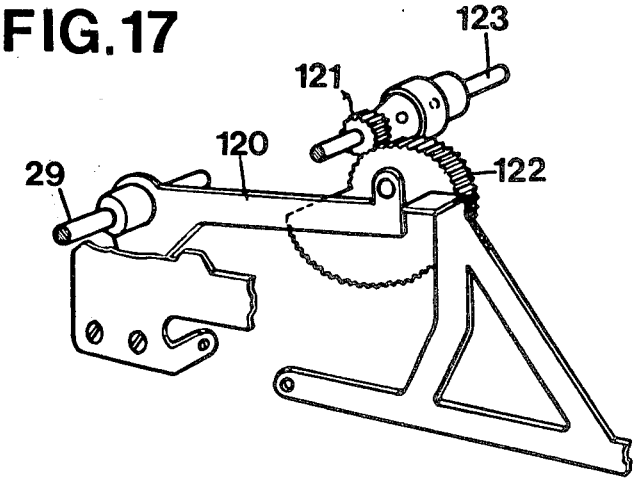
FIG. 17 is another partial view of the mechanism.

A control lever 28 integral with drive shaft 29 cooperates with a stud 30 in rocker 21 in the manner of a cam when a tab command is given. Temporary coupling means 120, 121 and 122 between drive shaft 29 and the continuously rotating machine function shaft 123 such as shown in FIG. 17 will be understood to be activated in any suitable manner well known in the art; when a decimal tab key 110 is pressed. This involves a rotation of drive shaft 29.

During a first phase of rotation, control lever 28 effects a swivelling of rocker 21 around axis 23 and the rocker 21 remains swivelled about the axis 23 during the rest of the drive shaft rotation. Since a pin 31 in rocker 21 is engaged in slot 32 of lever 20, it follows that the tab bar moves from inactive position to active position upon the activation of drive shaft 29. A rod 33 connected to rocker 21 and operated by key 113 from the keyboard 111 in any suitable known manner such as the direct connection as shown in FIG. 8 of the above referenced Gagnebin patent, also enables the selecting and clearing of tab blades 2 by rotation in a clockwise or counter-clockwise sense. During this rotation, a given tab blade 2 abuts against a selecting stop 48 or a clearing stop 48′, both mounted on the carriage 45.

The tab bar drive apparatus further comprises a lever 34 swivelling around fixed axis 35 and disposed orthogonally to the rotation axis of drive shaft 29. Lever 34 comprises two clips 36 and 37 which engage arm 12 of axle 3 in such a way that a rotation of lever 34 results in a sliding of the tab bar. Lever 34 is operated elastically by control lever 28 by means of an angle plate 38 rotating around axis 34 and a spring 39 affixed to lever 34 and to angle plate 38. A nose 40 in angle plate 38 is held against control lever 28 through the action of a return spring 41.

To facilitate assembly and servicing of the machine, fixed axis 35 is mounted on a support 42 having a hook 43 for fastening return spring 41, said support 42 being intended to be affixed to the extremity of axes 22 and 23 which are integral with lateral wall 7 of the machine.

Figure 6:
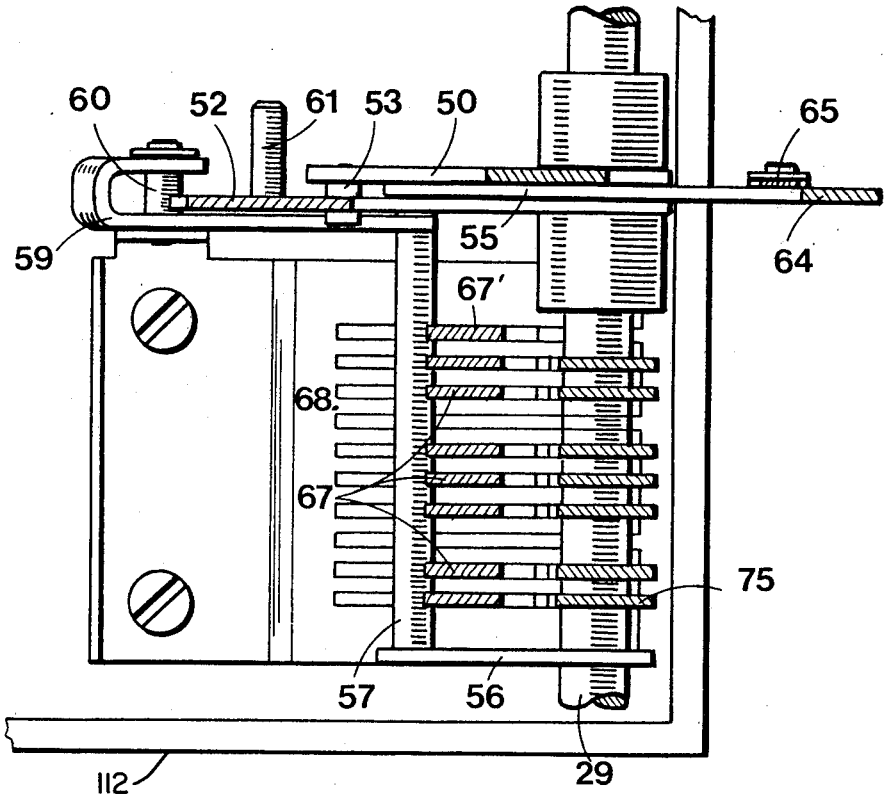
FIG. 6 is a partial section of part of the mechanism along the line 6—6 of FIG. 4.
Figure 4:
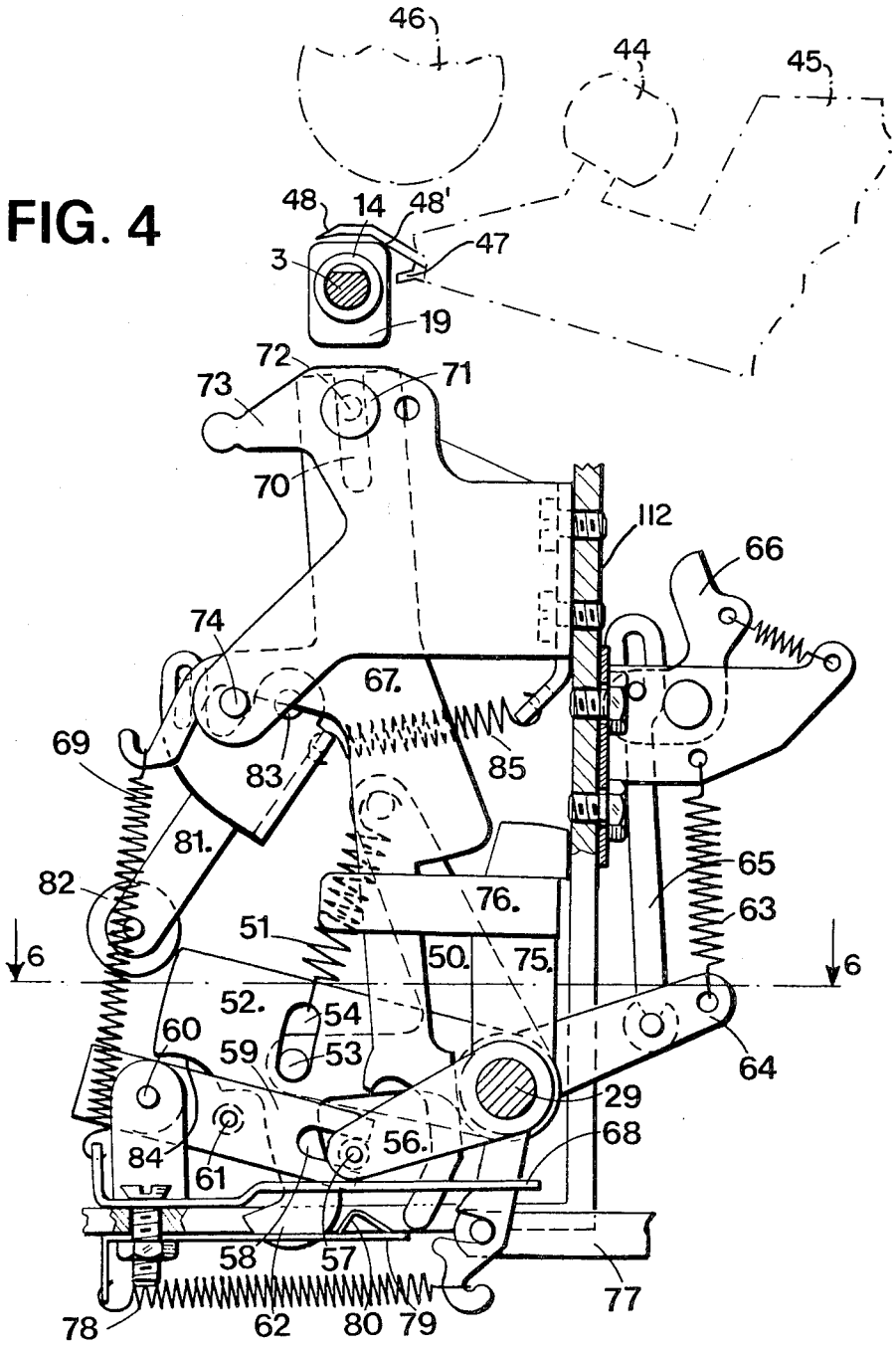
FIGS. 4 and 5 show laterally a part of the mechanism in two positions.
Figure 5:
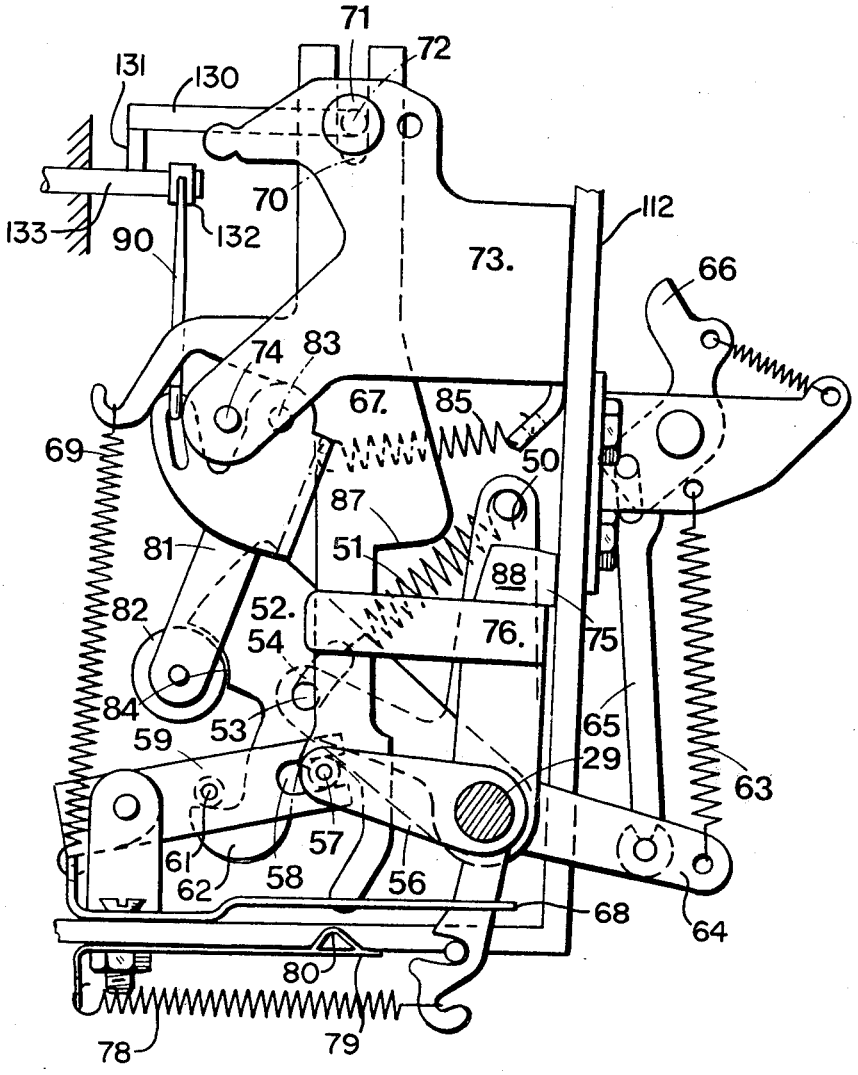

An assembly of decimal tab stops 67, represented in FIGS. 4 through 6, is also activated by drive shaft 29.

FIG. 4 shows the rest position of said assembly of decimal tab stops 67. FIG. 6 is a cutaway view along section line 6—6 of FIG. 4.

An angle plate 50 rotates with drive shaft 29. It operates elastically through spring 51 a swivelling key 52. A pin 53 in angle plate 50 is engaged in slot 54 of swivelling key 52 so as to limit their relative rotation.

Coaxially to the drive shaft 29 and swivelling key 52 are mounted two arms 55 and 56, free to rotate, upon which is placed a universal bar 57. The universal bar 57 is engaged in a notch 58 of a lever 59 which rotates around an axis 60 parallel to drive shaft 29.

Lever 59 comprises a rod 61 extending parallel to axis 60 and capable of cooperating with beak 62 of swivellng key 52.

Universal bar 57 and lever 59 are held down, in rest position, by a return spring 63 acting upon extension 64 of arm 55. A link 65, affixed to extension 64 of arm 55, is capable of activating a carriage release beak 66 connected to the link 65.

Eight decimal tab stops 67, corresponding to eight decimal tab keys 110 on the keyboard 111 of the machine, are guided in a comb 68 and held down by return springs 69. Said stops 67 comprise at their upper extremity a longitudinal slot 70, in which is inserted an axle 72 having grooves 71 corresponding to the stops 67. The axle 72 is mounted so as to slide between two plates 73 affixed to the body 112 of the machine. Each decimal tab stop 67 may therefore rotate around axle 72 and slide transversally to said axle 72 guided by groove 71.

A rod 74 is affixed between the two plates 73 and constitutes a stop for the decimal tab stops 67 in rest position. Control levers 75 of decimal tab stops 67 are mounted so as to rotate around drive shaft 29. Each lever 75 comprises two clips 76 disposed facing each other between which is guided a decimal tap stop 67, and includes a lower arm capable of cooperating with a tab key lever 77 corresponding to a decimal tab key 110 on the keyboard 111. Control levers 75 are held away from decimal tab stops 67 by return springs 78.

When tabbing, the tab key lever 77 corresponding to the decimal tab key 110 pressed on the keyboard 111, activates control lever 75 which effects a rotation of the corresponding decimal tab stop 67 around axle 72. Decimal tab stop 67 is held in this position by a leaf spring 79 comprising a rise 80 behind which the lower part of stop 67 engages. Drive shaft 29 is driven by temporary coupling means 120–123, shown in FIG. 17, during tabulation and, following an unloaded rotation of angle plate 50 and swivelling key 52 to compensate for play between rod 61 and beak 62, lever 59 swivels, drawing with it universal bar 57. The universal bar 57 cooperates with the decimal tab stop 67 chosen and moves it into the tabulation position represented in FIG. 5.

Referring to FIG. 17, the temporary coupling means comprises a pinion 121 fixed on the machine function shaft 123 and a cam 122 adapted to enter into contact with pinion 121 when a decimal tab key 110 is depressed. The cam 122 is pivotally mounted on a lever 120 which is integral with drive shaft 29.

In tabulation position, with drive shaft 29 having completely pivoted, a roller 82 on stop arm 81 rotating around an axle 83 mounted on one of the two plates 73 is made to engage corresponding curve 84 of swivelling key 52 by the action of a spring 85. In this position, link 65 is lowered sufficiently to activate carriage release beak 66.

With reference to that which has been described above, the decimal tab mechanism assembly functions as follows:

The activation of a decimal tab key 110 on keyboard 111 simultaneously effects a selection of the corresponding decimal tab stop 67, with leaf spring 79 maintaining the selected stop 67 in a position where it is capable of cooperating with universal bar 57 and with the activation of drive shaft 29. By rotating, the drive shaft 29 effects in succession: the placing into active position of the tab bar, with control lever 28 acting on stud 30 of the rocker 21; the sliding of the tab bar until elastic stop 10 encounters block 5 or until a tab blade 2 in active position meets a fixed stop 47 on the carriage 45; the emplacement of the selected decimal tab stops 67, with the rotation of drive shaft 29 necessary to compensate for the play existing between rod 61 and beak 62 and corresponding to the rotation of said shaft 29, inducing the two preceeding operations; the activation of carriage release beak 66.

The decimal tab mechanism is maintained in the tabulation position represented in FIG. 5 by roller 82 on stop arm 81.

The carriage 45, cooperates by means of a fixed stop 47 with a tab blade 2 in active position and causes the tab bar to slide against the effect of spring 39 between lever 34 and angle plate 38. The tab bar slides until plate 19 of stop piece 17 encounters the previously placed decimal tab stop 67. Driven by the tab bar, decimal tab stop 67 causes axle 72 to slide. By suitable means, such as a set of levers 130–132 rotating around an axle 133, the axle 72 operates a rod 90 acting upon stop bar 81 so as to free swivelling key 52 from roller 82.

Carriage release beak 66 is freed and the carriage 45 is blocked in the position reached. Under the effect of their respective return springs 69, 63, 54, 41, 39 and 26, the parts of the decimal tab mechanism resume their rest positions.

When the decimal 110 tab key is held down in order to induce a repetition of the operation, decimal tab stop 67 is held in place through support from a shoulder 87 resting on the upper part 88 of control lever 75.

In a preferred embodiment, decimal tab stop 67' corresponding to the ones column is fixed in active position. This has the advantage of assuring tabulation to the ones column if the chosen tabulation cannot be obtained. For example, it is impossible to tab to the millions column if the carriage 45 is less than six spaces from the ones column, and, in this case, the carriage 45 would stop at the ones column.

Figure 10:
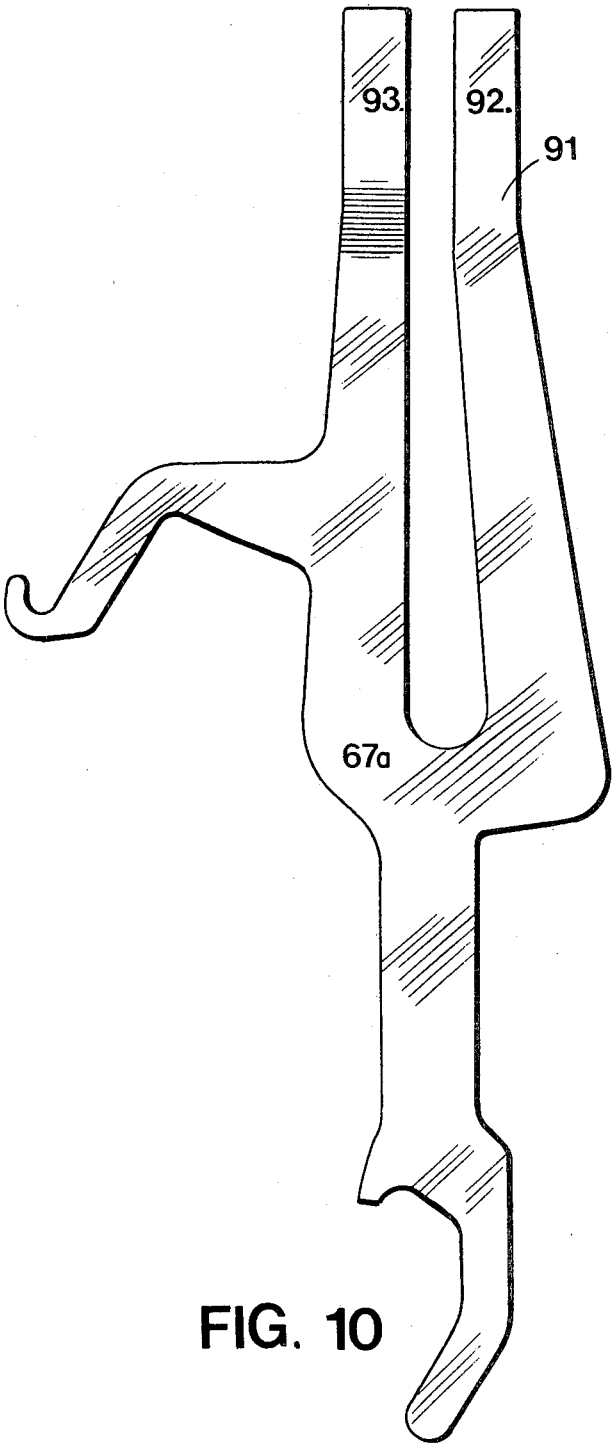
Figure 11:
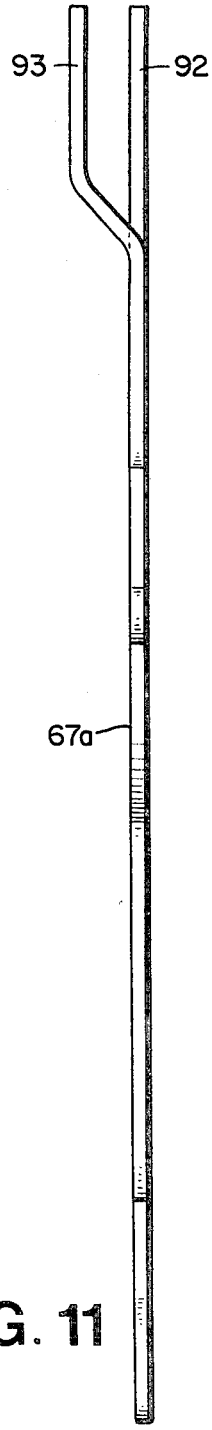
Figure 18:
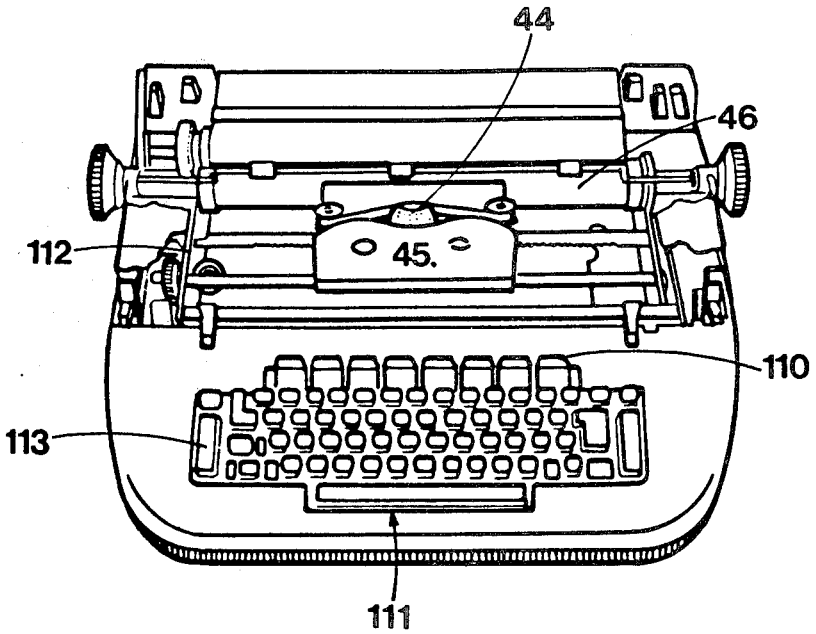
FIG. 18 is a schematic view of a typewriter comprising a tab mechanism according to the invention.

A decimal tab mechanism for dual typing pitch is also foreseen. A decimal tab stop 67*a* enabling decimal tabulation for two typing pitches is represented in FIGS. 10 and 11. It comprises at its upper extremities 91 two staggered feet 92 and 93 forming tab stops at two levels. Extremity 91 of each decimal tab stop 67*a* is engaged in slots 94 of sliding axle 72*a*. The slots 94 of axle 72*a* are disposed according to two different spacing pitches in two positions 95 and 96 on both sides of axle 72*a*.

Stop piece 17 comprises a plate 19 which may occupy two positions as shown in FIG. 13 so as to cooperate with one or the other, 92 or 93, of the feet of decimal tab stop 67*a*.

The shifting from one position to the other of plate 19 of stop piece 17 is assured by a rod 97 engaged in a notch 98 of foot 99 of piece 17. Rod 97 is integral with a lever 100 activated in a direction perpendicular to the axle 3.

I claim:

1. Decimal tab mechanism for a typewriter of the type having a printing element carried on a carriage moving parallel to a platen, said mechanism comprising a tab bar capable of being displaced longitudinally and comprising a series of tab blades which may be separately selected, activation means for activating the tab blades selected to place said selected tab blades in active position for cooperation with a carriage stop, an assembly of decimal tab stops each controlled by a key on a keyboard so as to be activated and made to cooperate with a tab bar stop, and a drive shaft connected by temporary coupling means to a continuously rotating machine function shaft, characterized in that the decimal tab mechanism comprises an apparatus for displacing the tab bar longitudinally ahead in the direction of typing, said apparatus being activated by the drive shaft by spring means, a first lever rotating around a stationary axis and disposed orthogonally to the rotation axis of the drive shaft, a control lever having a cam driving the means for activating the selected tab blade, said control lever and cam being integral with the drive shaft and acting on said activation means before the longitudinal displacement of the tab bar, a first angle plate swivelling around said stationary axis and having a nose which rests against the control lever, said spring means including a first spring urging said nose against said control lever, a second spring connecting said first angle plate to said first lever so that a rotation of the control lever is transmitted elastically to a rotation of the first lever cooperating with the tab bar, said first lever comprising clips which engage in an arm of an axle coaxial to the tab bar in such a way that a rotation of the first lever effects a sliding of said tab bar, and connection means between the drive shaft and the decimal tab stops, said connection means including devices for moving a selected decimal tab stop into active position only after longitudinal displacement of the tab bar.

2. Mechanism according to claim 1, characterized in that the control lever has at its free extremity the contour of said cam capable of cooperating with the means for activating the selected tab blades.

3. Mechanism according to claim 2, characterized in that said means for activating the selected tab blades are constituted by an apparatus effecting a rotation of the tab bar so as to place the selected tab blades in the trajectory of the carriage stop.

4. Mechanism according to claim 3, characterized in that said connection means are constituted by a second angle plate integral with the drive shaft and by a swivelling key driven elastically by said second angle plate, the swivelling key being capable of copperating, with play, with a universal bar intended to place a selected decimal tab stop in position.

5. Mechanism according to claim 4, characterized in that said play corresponds to the rotation of the drive shaft necessary to assure the placing in active position of the tab blades of the tab bar and the longitudinal displacement of said tab bar before the placing in position of the decimal tab stop.

6. Mechanism according to claim 5, characterized in that the decimal tab stop corresponding to the ones column is fixed in active position.

7. Mechanism according to claim 1, characterized in that each movable decimal tab stop comprises two different stop levels for stopping the tab bar, which tab bar may occupy two positions so as to cooperate with one or the other of the levels of each decimal tab stop, thus enabling decimal tabulation in accordance with two spacing pitches.

* * * * *